US005493776A

United States Patent [19]

Kammeraad et al.

[11] Patent Number: 5,493,776

[45] Date of Patent: Feb. 27, 1996

[54] METHOD OF INSTALLING VALVE GUIDE INSERT

[75] Inventors: James A. Kammeraad, Holland; Dwain L. Kamphuis, West Olive; Robert T. Ritt, Holland, all of Mich.

[73] Assignee: K-Line Industries, Inc., Holland, Mich.

[21] Appl. No.: 442,306

[22] Filed: May 16, 1995

Related U.S. Application Data

[62] Division of Ser. No. 266,122, Jun. 27, 1994, which is a division of Ser. No. 98,425, Jul. 27, 1993, Pat. No. 5,355,572, which is a division of Ser. No. 869,418, Apr. 14, 1992, Pat. No. 5,249,555.

[51] Int. Cl.[6] ..... B23P 15/00

[52] U.S. Cl. ..... 29/888.41; 29/525; 29/888.46

[58] Field of Search ..... 29/888.41, 888.42, 29/888.46, 525, 890.126, 890.13

[56] References Cited

U.S. PATENT DOCUMENTS

| | | | |
|---|---|---|---|
| 908,604 | 1/1909 | Odenkirchen . | |
| 2,319,546 | 5/1943 | Insley et al. . | |
| 3,209,445 | 10/1965 | Moskovitz | 29/275 |
| 3,274,674 | 9/1966 | Hooper | 29/214 |
| 3,531,134 | 9/1970 | Kammeraad . | |
| 3,599,992 | 8/1971 | Kammeraad . | |
| 3,685,126 | 8/1972 | Kane | 29/254 |
| 3,764,204 | 10/1973 | Kammeraad . | |
| 3,809,046 | 5/1974 | Kammeraad . | |
| 3,828,415 | 8/1974 | Kammeraad et al. . | |
| 3,828,756 | 8/1974 | Kammeraad et al. . | |
| 4,103,662 | 8/1978 | Kammeraad . | |
| 4,185,368 | 1/1980 | Kammeraad . | |

(List continued on next page.)

FOREIGN PATENT DOCUMENTS

| | | |
|---|---|---|
| 53832 | 5/1989 | Hungary . |
| 53831 | 5/1989 | Hungary . |
| 124163 | 7/1959 | New Zealand . |

OTHER PUBLICATIONS

Exhibit A is a catalog dated 1986 published by K–Line Industries, assignee of the present application, which on pp. 8–27 discloses various valve guide inserts, insert installion procedures, and equipment for reworking valve guides and for installing valve guide inserts.

*Primary Examiner*—Irene Cuda
*Assistant Examiner*—Marc W. Butler
*Attorney, Agent, or Firm*—Price, Heneveld, Cooper, DeWitt & Litton

[57] ABSTRACT

A thin-walled valve guide insert for lining and relining a valve guide of an internal combustion engine includes opposing ends each having a tapered insertion section thereon. The tapered insertion section defines a reduced outer diameter to facilitate installing the insert into a valve guide bore have a nonchamfered opening, and further defines a reduced inner diameter so that the insert has a substantially continuous wall thickness throughout its length and thus maintains the structural integrity of the insert from end to end. In the preferred embodiment, the valve guide insert is made of a phosphor bronze material of about 0.018 inch thickness or less, and includes a lengthwise slit therein. The insert is sprung open longitudinally along the slit and must be radially compressed so that the insert defines a sufficiently small outer diameter so that it can be axially installed in a press-fit condition into the valve guide bore of the engine. Both ends of the insert are formed with the tapered insertion section so that the insert can be positioned without regard to which end is directed toward the valve guide. Also disclosed is a tool for inserting the insert into the guide valve, the tool including an outwardly tapered junction adapted to spread one of the tapered insertion sections of the insert into longitudinal alignment with the insert to reduce the tendency to crush same from end forces exerted on the insert while installing the insert into the valve guide. Still further a process is disclosed for forming the guide valve insert with ends having tapered insertion sections thereon.

7 Claims, 3 Drawing Sheets

U.S. PATENT DOCUMENTS 4,231,693 11/1980 Kammeraad .
4,414,723 11/1983 Kammeraad et al. .
4,417,376 11/1983 Kammeraad et al. .
4,465,040 8/1984 Pelizzoni .
4,502,696 3/1985 Kammeraad .
4,573,340 3/1986 Kammeraad .
4,768,479 9/1988 Kammeraad .
4,822,061 4/1989 Kammeraad .
5,249,555 10/1993 Kammeraad et al. .

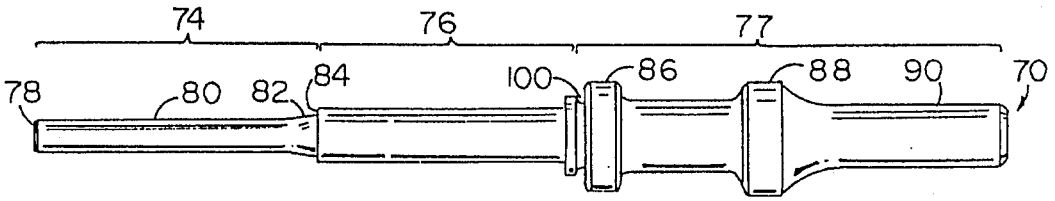
FIG. 8
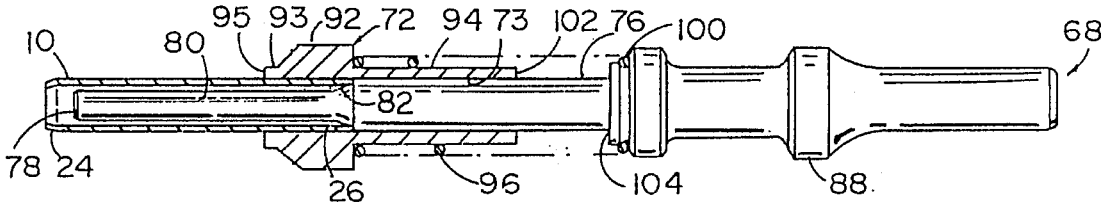
FIG. 9
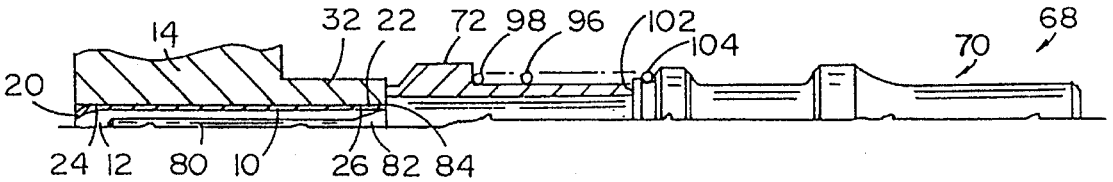
FIG. 11
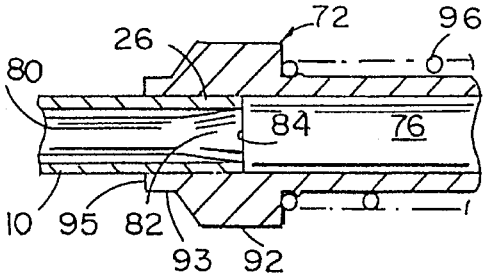
FIG. 10
PROCESS
- REBORE VALVE GUIDE
- INSERT LINER
- BROACH ID OF LINER
FIG. 12
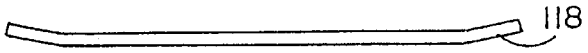
FIG. 14
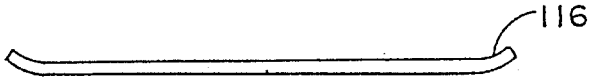
FIG. 13
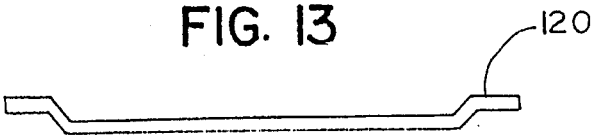
FIG. 15

METHOD OF INSTALLING VALVE GUIDE INSERT

This is a divisional application of application Ser. No. 08/266,122, filed Jun. 27, 1994 entitled METHOD FOR MANUFACTURING AND INSTALLING VALVE GUIDE INSERT, which in turn is a divisional application of then application Ser. No. 08/098,425, filed Jul. 27, 1993 entitled VALVE GUIDE INSERT INSERTION TOOL (now U.S. Pat. No. 5,355,572), which in turn is a divisional application of then application Ser. No. 07/869,418, filed Apr. 14, 1992 entitled VALVE GUIDE INSERT (now U.S. Pat. No. 5,249, 555).

BACKGROUND OF THE INVENTION

The present invention relates to valve guide inserts, and in particular to a valve guide insert shaped to facilitate installation into a valve guide bore.

Valve guides in internal combustion engines can become worn through extended use. This is especially true when the valve guide is machined in a cylinder head cast from iron or other nondurable material. Techniques have been developed for reaming a worn guide and inserting a thin-walled, tubular member formed from phosphor bronze or similar material into the resultant bore to refurbish the guide.

The first such technique is disclosed in U.S. Pat. No. 3,828,756, issued to James Kammeraad and assigned to the assignee of the present invention. The technique includes forming a slitted tubular insert from a flat sheet of phosphor bronze material and press-fitting the insert into a reamed valve guide bore. The tubular member is properly sized so that the slit is substantially closed when the insert is fitted within the valve guide bore. A tool is then forced down the insert to work the metal to further seal the slit and also to form the surface of the insert contacting the valve stem. In some ;inserts, spiral grooves are formed on the surface contacting the valve stem to provide a path for supplying lubricating oil to the surface of the reciprocating valve stem.

An improvement to this insert is disclosed in U.S. Pat. No. 4,768,479, also issued to James Kammeraad and assigned to the assignee of the present invention. This patent teaches preforming on the interior surface of the thin-walled insert a series of discontinuous spiral grooves. These grooves act as oil reservoirs, furnishing oil to lubricate the reciprocating valve stem. The discontinuous nature of them prevents any tendency of the oil to flow through the insert into the combustion chamber.

Use of these thin-walled, phosphor bronze valve guide liners or inserts has become very popular, commencing in the early-to-mid-1970s, since they provide improved durability, improved heat transfer during operation of the engine, and also since less material needs to be removed from the engine cylinder head during reboring of the worn valve guide. The use of thin-walled phosphor bronze inserts has become so successful, in fact, that they are now being installed in production engines at the factory to increase the reliability of the valve guides.

One problem associated with the use of these thin-walled valve guide inserts is the tendency to crush or deform during installation. This tendency occurs not only at the leading end of the insert which is initially being driven into the valve guide bore, but at the trailing end as well, since that is where the driving force is applied. The thinner the insert, the more apt the installer is to encounter this problem. The preformed discontinuous spiral on the interior of the insert which is the subject of the aforenoted U.S. Pat. No. 4,768,479 has aggravated this tendency, since the grooves which result from the removal or displacement of material weaken the sidewalls even further.

The traditional method of installation compensates for this tendency to crush or deform by first encapsulating the insert in an installation sleeve having a funnel-like opening through which the insert is initially forced to radially compress it. The insert then traverses into a section of the installation sleeve which has an inner diameter basically equal to that of the valve guide bore into which the insert is installed. The installation sleeve is then placed over and in alignment With the valve guide bore, and a punch-like tool used to force the insert from the sleeve into the valve guide bore. The punch-like tool has a leading mandrel or pilot having an outer diameter approximately equaling the inner diameter of the compressed insert. The driver section of the tool, which is integrally formed and axially aligned with the mandrel has a circumferential driving shoulder which flares from the mandrel at a right angle and has an outer diameter slightly less than the outer diameter of the compressed insert and the inner diameter of the valve guide bore. See FIG. 4 of U.S. Pat. No. 3,828,756. The mandrel and installation sleeve restrain the insert from collapsing under the force of the driving shoulder. This method of installation, while effective, is somewhat time-consuming and requires extreme care on the part of the operator to insure that the installation sleeve directly overlies the valve guide bore.

Another prior art method is to bevel or chamfer the valve guide bore opening, and thus provide a funnel-like surface to direct the thin-walled insert into the valve guide bore during installation. The chamfered bore has been used in conjunction with the installation sleeve of the type discussed in U.S. Pat. No. 3,828,75.6, the chamfer, in this case, primarily functioning to reduce the degree of care which otherwise must be taken to insure that the installation sleeve directly overlies the valve guide bore. See Hungary Patent Publication 53831, filed May 16, 1989. The chamfered bore has also been used in conjunction with an installation sleeve which compresses only the top or driven part of the insert, the lead end of the insert being radially compressed by the chamfer and/or by an operator as the lead end enters the valve guide bore. In either case, chamfering the bore opening involves an extra manufacturing step and a special reamer. Also, the chamfering operation reams away material at the end of the valve guide bore which ought to be retained, since it supports the valve stem at the end of the valve guide bore where the lateral forces on the valve stem are most pronounced. Compounding this problem is the fact that many chamfering operations are not well controlled, leading to excessive material being removed.

Summary of the Invention

The present invention provides a valve guide insert for valve guides of internal combustion engines and the like, which is capable of insertion into a valve guide bore having a nonchamfered opening. The valve guide insert includes a thin-walled, generally cylindrically-shaped, metallic tube having ends. At least a section of the insert central to the ends has an outer diameter substantially equal to or slightly greater than the inner diameter of the valve guide bore within which the insert is to be installed, such that the insert, when positioned within said bore, will be retained by a press fit. The central section of the insert has an inner diameter about equal to or slightly greater than the diameter of the valve stem which is to reciprocate therein, the inner and outer diameters of the central section defining the approximate desired wall thickness of the insert when installation and reworking are complete.

At least one of the ends of the insert has a reduced inner diameter and a reduced outer diameter relative to the central section providing a tapered insertion section adapted to lead the insert into said bore. The tapered insertion section has a wall thickness substantially equal to or greater than the wall thickness of the central section, such that the tapered insertion section will not be prone to crush during installation of the insert into the bore. According to the preferred embodiment of the invention, the wall thickness of the tapered insertion section is such that when the tapered insertion section is reworked after installation of the insert into the bore to bring the inner diameter thereof substantially equal to the inner diameter of the central section, the outer diameter of the tapered insertion section will be substantially equal to the outer diameter of the central section.

In a narrower aspect, the valve guide insert comprises a thin-walled, generally cylindrically-shaped, metallic tube made of resilient material with a slit along its length, the insert being sprung open slightly but compressible to close the slit and to form the outside diameter of the central section to be press-fit into the valve guide bore. In the preferred embodiment, the valve guide insert is made of phosphor bronze of about 0.018 inch thickness or less.

Another aspect of the present invention comprises a tool for inserting the above-noted valve guide inserts into a valve guide bore. The tool includes a mandrel or pilot section and a driver section, the sections being interconnected by a frusto-conical junction. The driver section includes, adjacent the base of the frusto-conical junction, a circumferential, square driving shoulder adapted to engage and drive the bore-remote extremity of the insert. The frusto-conical junction is adapted to flex the taper from the valve guide bore-remote tapered insertion section on the valve guide insert. This flexing is accomplished within an installation sleeve having an inner diameter sufficiently large to accommodate the driving shoulder which is somewhat larger in diameter than the valve guide bore.

Another aspect of the present invention provides a process for making a valve guide insert having ends with tapered insertion sections.

These and other aspects, advantages and objects of the present invention will be further understood and appreciated by those skilled in the art by reference to the following specification, claims and appended drawings.

BRIEF DESCRIPTION OF THE DRAWINGS

FIG. 8 is a side view of the driving member of a tool used for inserting the valve guide insert shown in FIG. 2 into a selected valve guide bore;

FIG. 9 is a side cross-sectional view of the tool for installing a valve guide insert, the tool shown with a valve guide insert being held thereon ready for insertion into a valve guide bore;

FIG. 10 is an enlarged view of a portion of FIG. 9 with clearances being emphasized for illustrative purposes;

FIG. 11 is a fragmentary side cross-sectional view of the valve guide insert after insertion of the valve guide insert into the valve guide bore by the tool shown in FIG. 9;

FIG. 12 is a flow chart illustrating the steps of installing a valve guide insert into a valve guide bore;

FIGS. 13–15 are side cross-sectional views of three embodiments of the guide insert blank material after forming the edge portions thereof while the blank material is substantially flat and before forming the cylindrical shape of the insert;

DETAILED DESCRIPTION OF THE PREFERRED EMBODIMENT

Figure 1:
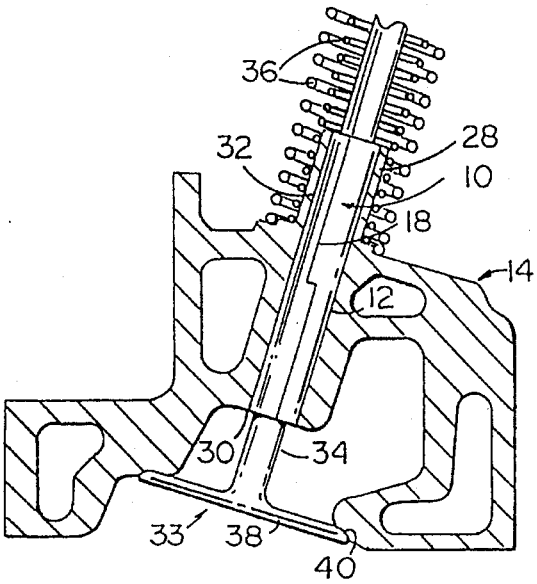
FIG. 1 is a side-elevational, cross-sectional view of a valve guide insert embodying the present invention shown as installed in a valve guide bore of an engine cylinder head.

Referring now to the drawings and to FIG. 1 in particular, a valve guide insert 10 embodying the present invention is shown, insert 10 being adapted for insertion into a nonchamfered valve guide bore 12 of an overhead cylinder head 14 for an internal combustion engine (not shown). Insert 10 is adapted for use in a cylinder head 14 with a valve guide bore 12 machined therein. (FIG. 1). Cylinder head 14 includes an exposed shoulder portion 32 located at one end of valve guide bore 12. Ordinarily, the exposed shoulder 32 will be integrally cast with head 14 and thereafter machined to proper dimensions. A valve stem 34 of valve 33 is passed through valve guide bore 12 during assembly. A valve spring 36 encircles exposed shoulder portion 32 of the valve guide assembly, and valve 33 is conventionally retained with respect thereto by a pair of valve keepers (not shown). Valve stem 34 extends downwardly and terminates in a valve flange 38 adapted to seat against a valve seat 40. A suitable valve seat 40 is machined into the lower surface of cylinder head 14. The valve opens into an engine combustion chamber (not shown). Valve spring 36 retains the valve in a closed position with respect to seat 40 except when forced downwardly by a rocker arm (not shown) or the like in proper operational sequence.

Figure 2:
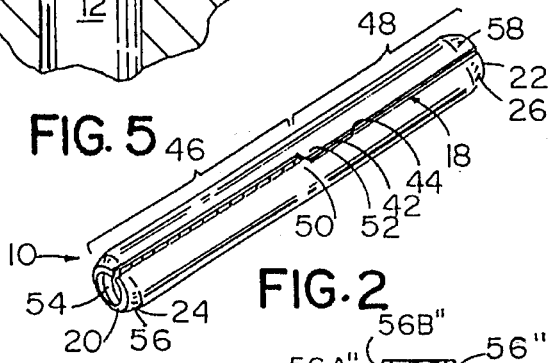
FIG. 2 is a perspective view of the valve guide insert shown in FIG. 1 before installation.

Valve guide insert 10 (FIG. 2) is a thin-walled, cylindrically-shaped, metallic tubular member made of phosphor bronze material, and includes a slit 18 extending lengthwise from end 20 to opposing end 22 so that the insert can be radially compressed and press-fit into valve guide bore 12. Insert 10 includes tapered insertion sections 24, 26 formed inwardly at ends 20, 22 to facilitate insertion of insert 10 into a nonchamfered valve guide bore 12 having a square lip 28 (FIG. 1). Due to the thinness of the walls of insert 10, the ability to introduce insert 10 into valve guide bore 12 without abutting lip 28 or otherwise interfering with the leading end 20 as insert 10 enters valve guide bore 12 is particularly important in order to avoid undesirably crushing or deforming insert 10. To this end, the wall thickness is maintained throughout the length of the insert, including at the tapered insertion sections 24, 26. This constant or near-constant wall thickness preserves the structural integrity of tapered insertion sections 24, 26, discouraging crushing or deforming during installation. This constant or near-constant wall thickness also permits the insert to be reworked after installation to bring its inner diameter (approximating the diameter of the valve stem to reciprocate therein) and its outer diameter (slightly greater than the inner diameter of the valve guide bore 12) equal throughout its length as shown in FIG. 1. Full wall thickness at the extremities is important, since these are typically the areas which will wear first.

Figure 3:
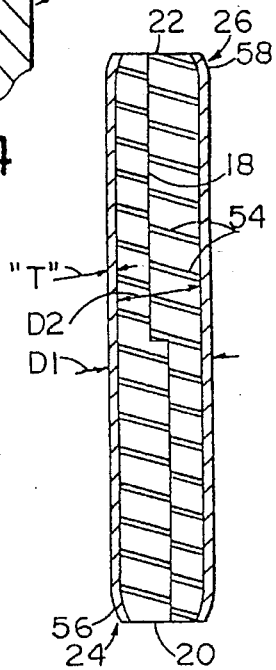
FIG. 3 is a side cross-sectional view of the valve guide insert shown in FIG. 2 but with the insert being radially compressed to close the slit.

Valve guide insert 10 (FIGS. 2 and 3) is adapted to be press-fit within valve guide bore 12 so that slit 18 is substantially closed after insert 10 is installed. Slit 18 is bounded by first and second offset edges 42, 44 which are preformed in a blank of flat stock before the tubular shape of the insert is formed. The dimensions of the flat stock are selected such that, after the insert is fitted into the valve guide bore 12, slit 18 will be closed. The blank is chosen with a particular thickness T and width to form diameters D1 and D2. Diameter D1 is chosen for the particular valve guide bore within which the insert is to be installed, and diameter D2 is chosen so that it can be broached or otherwise worked to an inner diameter for receiving the particular valve stem 34 desired. Diameter D2, of course, must be such as to require that the insert be press-fit into the bore and retained therein, at least in part, by a tendency to radially expand. It is contemplated that this wall thickness T can be any thickness desired, but is preferably between about 0.010 and 0.025 inch, and most preferably about 0.015 to 0.018 inch. A thinner wall thickness T promotes improved heat transfer, as noted below.

Valve guide insert 10 includes a first finger member 46 and a second finger member 48 defined by overlapping transverse edge portions 50, 52. Overlapping transverse edge portions 50, 52 inhibit oil flow along the seam 18 and also prevent skewing or twisting as the insert 10 is press-fit into valve guide bore 12. Valve guide insert 10 also includes multiple offset spiral grooves 54 that retain oil along the interior length of insert 10. For further information on the general construction of such an insert, reference is made to aforenoted U.S. Pat. No. 3,828,415, issued Aug. 13, 1974, entitled METHOD AND APPARATUS FOR REBUILDING VALVE GUIDES; U.S. Pat. No. 4,103,662, issued Aug. 1, 1978, entitled, INSERT FOR REBUILDING VALVE GUIDES; and U.S. Pat. No. 4,768,479, issued Sep. 6, 1988, entitled OIL-SEALING VALVE GUIDE INSERT AND METHOD OF MANUFACTURE, all of which are incorporated herein by reference.

It is believed that grooves 54 affect the ease with which insert 10 can be press-fit into valve guide bore 12 in at least two ways. Grooves 54 somewhat weaken the sidewalls of the insert 10, rendering the insert more prone to accordion-type collapse during the press-fitting operation. Also, grooves 54 affect the wall structure in a way that increases the frictional resistance to insertion. This is evidenced by the increased retention strength of inserts having grooves over comparably-sized inserts without grooves. For example, experimental test data has shown that the retention strength of an insert with grooves installed in a valve guide bore is about 20–50% or more above the retention strength of a comparable insert without grooves.

Figure 6:
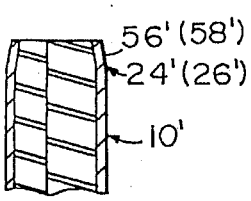
FIG. 6 is a partial side cross-sectional view of a second embodiment of a valve guide insert.
Figure 7:
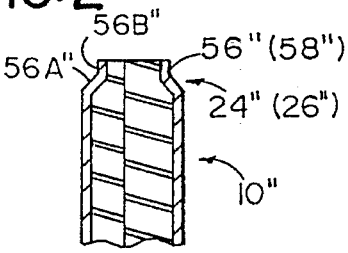
FIG. 7 is a partial side cross-sectional view of a third embodiment of a valve guide insert.

The insert of the present invention can be installed with relative ease, whether or not it includes the oil-retaining grooves 54. To this end, the liner is provided at either end with a tapered insertion section 24, 26. A number of different geometric configurations are contemplated for this tapered insertion section. In insert 10 (FIG. 3), tapered insertion sections 24, 26 have arcuately-shaped outer tapered surfaces 56, 58. In another embodiment, an insert 10' (FIG. 6) includes tapered insertion sections 24', 26' having conically-shaped outer tapered surfaces 56', 58'. In still another embodiment, an insert 10" (FIG. 7) includes tapered insertion sections 24", 26" having stepped outer surface 56", 58" with fore-shortened, conically-shaped wall portion 56A" and a cylindrically nontapered terminal tip portion 56B".

In each of the inserts 10, 10' and 10", the wall thickness T is substantially maintained throughout the length of the tapered insertion sections. This is important for two reasons. First, the tapered insertion sections take the brunt of the press-fitting forces at both the valve guide bore entry point and at the force application point. The constant or near-constant wall thickness, in this regard, insures that the tendency to crush at these locations will be minimized during press-fitting installation. Second, this constant or near-constant wall thickness permits the insert to be reworked by broaching or the like, after being press-fit into bore 12, so that the insert will have a generally constant wall thickness throughout its length. This insures maintenance of the structural integrity of end sections 24, 26, since it is at end sections 24, 26 where the greatest support for reciprocating valve stem 34 is required.

Figure 5:
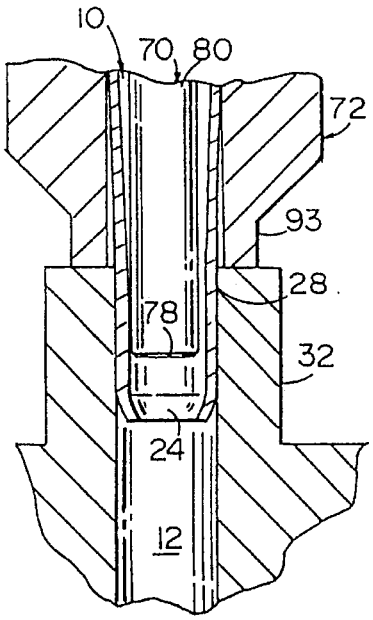
FIG. 5 is a side cross-sectional view illustrating the valve guide insert partially inserted into the valve guide bore by a tool shown in FIGS. 8–11, the clearances being emphasized for illustrative purposes.
Figure 4:
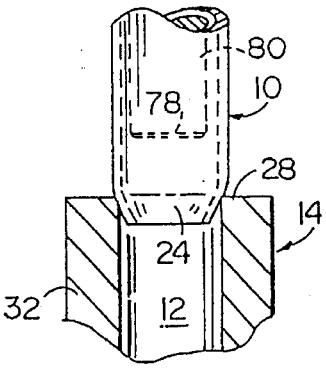
FIG. 4 is a fragmentary side view of the valve guide insert shown in FIG. 2 positioned adjacent and in alignment with a valve guide bore and ready for insertion therein.

Inserts 10, 10' and 10" advantageously can be readily installed into a valve guide bore 12 having a square lip 28. As shown in FIG. 4, end 20 of tapered insertion section 24 of insert 10 fits partially into valve guide opening 30 as defined by lip 28. Insert 10 is then urged fully into valve guide bore 12 with the walls of insert 10 following insertion section 24 into valve guide bore 12 (FIG. 5).

Once fully inserted therein, the inside diameter of insert 10 is reworked by broaching to accurately form the inside diameter so that insert 10 as installed can properly receive reciprocating valve stem 34 (FIG. 12). The broaching process also reduces or eliminates air pockets between insert 10 and valve guide bore 12, thus improving heat transfer by reducing hot spots during operation of the engine. Broaching, as noted, also reforms the tapered insertion sections 24, 26 outwardly so that they assume the configuration of FIG. 1, having a generally constant inner and outer diameter throughout their length and being in intimate contact with the walls of bore 12 throughout their length. A broaching process and tool suitable for these purposes is disclosed in U.S. Pat. No. 4,573,340, issued Mar. 4, 1986, entitled VALVE GUIDE LINER BROACH AND TOOL. Inserts 10' and 10" can be similarly inserted.

Insert 10 (FIGS. 2–3) includes identical tapered insertion sections 24, 26, tapered inwardly at ends 20, 22, respectively, to present inwardly tapered surfaces 56, 58, respectively. It is contemplated that only one end of insert 10 need have the tapered portion. However, by tapering both ends, an operator using insert 10 need not be concerned with aligning the wrong end of the insert adjacent valve guide bore opening 30. It is also contemplated that the insertion section will be about ⅛ of an inch long, though other sizes can be used. The tapered insertion section, as will be pointed out in detail, permits use of an installation sleeve 72 having a diameter greater than that which could otherwise be used. This greater diameter, in turn, permits use of an installation tool 68 which automatically compensates for the taper at the bore-remote extremity during the press-fitting installation.

This installation tool 68 (FIGS. 8–11) includes an elongate driver member 70, and an insert installation sleeve 72 which fits over the end of elongate driver member 70 and holds insert 10 thereon. Driver member 70 includes an elongated mandrel or pilot section 74 in the shape of a rod, an elongated driver section 76 which is also rod-like and axially extends from mandrel 74, and a shank 77 mounted to the rearward end of driver section 76.

Mandrel 74 includes a beveled leading end 78 to assist in placing insert 10 thereonto. The body 80 of mandrel 74 can be longer or shorter than the insert 10 which it supports. In the illustrated example (FIG. 9), mandrel 74 is shorter than insert 10. Thus, formed end 24 extends outwardly beyond mandrel 74 as shown in FIG. 9. Due to the axial and radial strength of insert 10, this has not been a problem during installation of the illustrated insert 10.

Mandrel 74 tapers outwardly in frusto-conical fashion as indicated at 82 at its junction with driver section 76. Driver 76 includes a circumferential, square driving shoulder 84 adjacent the widest part of junction 82. Driving shoulder 84 is adapted to contact tapered insertion section 26 of insert 10 and drive insert 10 into valve guide bore 12. Outwardly tapered frusto-conical junction 82 begins about 0.25 inch or less from the face or driving shoulder 84 of driver section 76 and extends rearwardly at an angle of about 5° or less.

Shank 77 is axially aligned and integrally interconnected to mandrel 74 and driver section 76. Shank 77 includes front and rear enlargements 86, 88, with a protrusion 90 extending rearwardly from rear enlargement 88. Protrusion 90 provides a means for gripping and driving elongate driver member 70 such as by an impact gun (not shown), while enlargements 86, 88 provide an area for grasping and aligning installation tool 68 with a selected valve guide bore 12.

Installation sleeve 72 (FIGS. 9, 10 and 11) of installation tool 68 is a cylindrically-shaped member with a bore 73. Sleeve 72 is slidingly positioned over driver section 76 and mandrel 74 of driving member 70. Installation sleeve 72 includes an enlarged midsection 92 for ease of grasping and an elongated tubular section 94. Midsection 92 includes a necked forward portion 93 with bore-abutting face 95. Necked portion 93 provides clearances for casting interferences around valve guide bore 12 as installation tool 68 is used to press-fit insert 10 into valve guide bore 12, while front face 95 abuts lip 28 as insert 10 is press-fit into valve guide bore 12 (FIG. 11). Installation sleeve 72 also includes a rearward end 102 on tubular section 94 that is adapted to abut a forward end 104 of shank 77, as described below.

A coil spring 96 is positioned around tubular section 94 of installation sleeve 72. The ends of spring 96 are retained by a first depression 98 on tubular section 94 adjacent enlarged midsection 92 and by a second depression 100 on front enlargement 86. Spring 96 biases installation sleeve 72 forwardly on driver member 70 to a position partially on mandrel 74 of driver member 70. Installation sleeve 72 has a length about equal to driver section 76. As insert 10 is press-fit into valve guide bore 12 (FIG. 11) and reaches the desired home position, the rearward end 102 of installation sleeve 72 abuts the forward end 104 of shank 77. Thus, installation tool 68 automatically sets or controls the desired depth of the insert in valve guide bore 12.

As insert 10 is positioned on mandrel 74, junction 82 flexes the taper from tapered insertion section 26, permitting square driving shoulder 84 to apply a longitudinal, as opposed to a crushing, force on section 26, thus driving the insert into the valve guide bore. The outside diameter of mandrel body 80 is slightly less than diameter D2 of liner 10. The inner diameter of installation sleeve 72 is slightly greater than diameter D1 of insert 10. The two diameters (of mandrel body 80 and installation sleeve 72) are selected so as to provide clearance for frusto-conical function 82 as well as adequate support for liner 10 during installation as noted below. The relative ease with which the insert can be forced into the valve guide bore as a result of the provision of tapered insertion section 24 permits the diameter of installation sleeve 72 to be enlarged relative to previous installation sleeves, thus accommodating the increased diameter of junction 82 within the sleeve.

To facilitate understanding of the present invention, the following example gives specific dimensions illustrating one particular installation tool 68 for installing a particular valve guide insert 10 in a particular rebored valve guide bore 12:

Example

Initially the exemplified valve guide 12 is rebored to a maximum diameter of about 0.3735 inches. A liner 10 is then chosen for installation in the valve guide to bring the valve guide bore diameter to an inner diameter of about 0.3438 inches (i.e. 11/32 of an inch) for receiving a particular valve stem 34. Specifically, liner 10 is chosen with a wall thickness of about 0.016 inches and an outer diameter larger than 0.3438 inches so that the inner diameter of the liner after being press-fittingly installed in valve guide bore 12 is about 0.3415 inches (before broaching). This allows the inner diameter of the installed insert to be later broached to the desired valve guide bore diameter of 0.3438 inches, with at least 0.001 of phosphor bronze material being moved by the broaching process. Liner 10 is chosen with a length as needed to fill valve guide bore 12, which in this example is about 2.250 inches.

An appropriate tool 68 is chosen for installing the particular liner 10 noted above. In the given example, the diameter of mandrel 74 of driver member 70 is about 0.328 inches and the length about 2.00 inches. Notably, the length could be longer than insert 10 if desired. Outwardly tapered junction 82 of the chosen driver member has a maximum dimension of about 0.348 inches, and driver section 76 has an outer diameter of about 0.384 inches. Thus, driver shoulder 84 has a width of about 0.018 (i.e. total width dimension of 0.036 inches including both sides). Insert installation sleeve 72 has an inner diameter of about 0.386 inches, and a length equal to the distance from driver shoulder 84 to the forward end 104 of shank 77, which distance is about 1.250 inches in the present example.

The selected liner 10 is placed on mandrel 74 so that insertion section 26 rides up onto outwardly tapered junction 82 to create an outer diameter at driver shoulder 84 of about 0.380 inches (i.e. the maximum dimension 0.348 inches of junction 82 plus two wall thicknesses 0.016 of insert 10). As insertion sleeve 72 is slid forwardly from driver section 76 telescopingly onto insert 10, the taper is removed from tapered insertion section 26 of liner 10 and tapered insertion section 26 is forced to a substantially longitudinally aligned position with the length of liner 10. Also, liner 10 is held in a radially compressed condition so that slit 18 closed or near is closed or near closed. Due to the rigidity of the phosphor bronze material, slit 18 is closed or near closed even along the part of insert 10 which hangs outwardly from insertion sleeve 72 on mandrel 74. Thus, insert 10 is held at an outer diameter of about 0.386 inches along its length which notably is slightly greater than rebored valve guide bore 12 which has a diameter of about 0.3735 in this example. However, tapered insertion section 24 forms an inwardly tapered end that is adapted to ramp into nonchamfered opening 30 of rebored valve guide bore 12, as noted above and illustrated in FIGS. 4, 5 and 11. As junction 82 enters valve guide bore 12 during installation of insert 10 into bore 12, the junction 82 and insert 10 combine to form a maximum diameter of 0.380. Since valve guide bore 12 is only 0.3735 in diameter, this creates an interference at lip 28 of valve guide bore 12. However, this interference does not create a problem due to the short length of junction 82, which is only about 0.250 inches or less, and the low angle of junction 82, which is only about 5° or less.

As noted previously, the dimensions in the Example are given only to facilitate an understanding of the invention, and the invention is not to be limited by them. By way of comparison, for a chamfered valve guide bore of similar size to the valve guide in the example, prior known tools used by the assignee of the present invention would most likely have a continuous outer diameter on the mandrel of about 0.338, no tapered junction, and a continuous outer diameter on the driver section of about 0.378 inches. The prior sleeve holder would have an inner diameter of about 0.381 inches.

Figure 16:
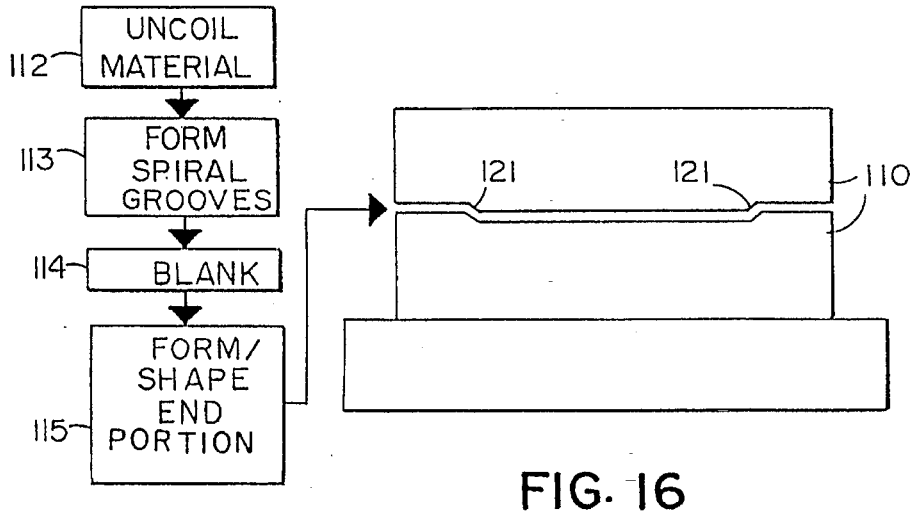
FIG. 16 schematically illustrates a process including use of a set of progressive forming dies for forming the guide valve insert blank material into the cylindrical shape of the valve guide insert.

Insert 10 of the present invention can be manufactured in a number of different ways. As illustrated in FIG. 16 the insert material is first uncoiled from a coil of stock in step 112, and spiral grooves 54 are formed in the material in step 113 such as is disclosed in the aforenoted U.S. Pat. No. 4,185,368. Insert blanks are then stamped from the uncoiled stock in step 114 and the general contour of end portions 24, 26 are formed along the edges of the guide insert material in step 115. Configurations 116, 118, 120 can be formed a number of different ways, such as by stamping, roll-forming and other bending methods.

Three configurations of blanks formed in step 115 are illustrated in FIGS. 13–15. FIG. 13 illustrates a radiused insertion section 116, while FIG. 14 illustrates an angled insertion section 118, and FIG. 15 illustrates a stepped insertion section 120. These configurations 116, 118 and 120 correspond to inserts 10 (FIG. 3), insert 10' (FIG. 6) and insert 10" (FIG. 7), respectively. However, it is contemplated that a variety of different configurations of tapered insertion sections can be formed and still be within the broader aspects of the present invention.

As shown in FIG. 16, a form fixture 110 is used to form the tubular shape of insert 10 (or insert 10' or 10"). Presently, two strikes of the forming dies are used to fully form the cylindrical shape of insert 10, although it is contemplated that more or less can be used, or that sizing dies can be used if necessary to properly shape insert 10. In FIG. 16, angled lips 121 are used to represent the position of tapered insertion sections 24, 26 during the forming process.

Figure 17:
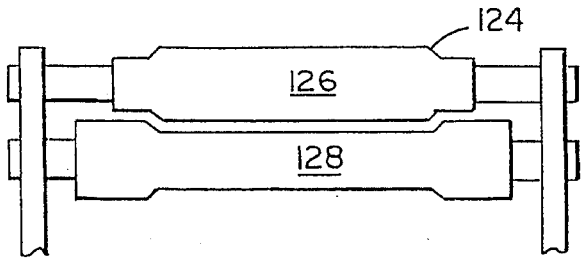
FIG. 17 schematically illustrates roll-forming rolls for forming the edges of the guide valve insert material before use of the forming dies in FIG. 16.

It is contemplated that roll-forming roller pairs 124 (FIG. 17) including an upper roller 126 and a lower roller 128 can be used to perform step 115 and form edge portions 116, 118, 120. Notably, roll-forming rollers 126, 128 can be used to form ends 116, 118, 120 on guide insert material either before or after the uncoiled material is cut into blanks in step 114.

Figure 18:
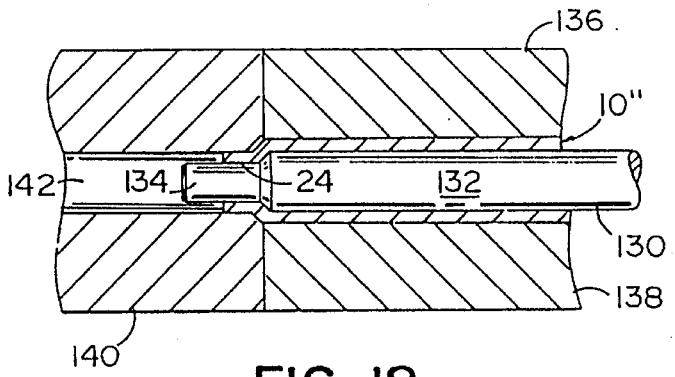
FIG. 18 is a side cross-sectional view of an internal center pin and forming block for forming the ends of the valve guide insert.

FIG. 18 illustrates another method of forming tapered insertion sections 24, 26. In FIG. 18, a guide insert with a continuous diameter is supported from within by a center pin 130. Center pin 130 has a midsection 132 with a large diameter for supporting the length of insert 10" at the inner diameter D2, and also includes a tip section 134 having a reduced diameter for supporting the inside of tapered insertion sections 24", 26" during the forming process. To form insert 10", forming blocks 136, 138 are closed onto a cylindrically-shaped insert with center pin 130 therein. A forming block or crowning block 140 is then pressed onto the tip section 134 of pin 130 to form tapered insertion sections 24", 26". Forming block 140 includes a shaped bore 142 that engages the ends of the insert and tip section 134 to crown the end of insert 10" and form tapered end portions 24", 26". Notably, insert 10" includes slit 18 allowing insert 10" to spring open slightly as pin 180 is axially removed from insert 10". It is contemplated that forming block 140 can be used simultaneously with form fixture 110 (FIG. 16) or can be used separately in a subsequent step.

Figure 19:
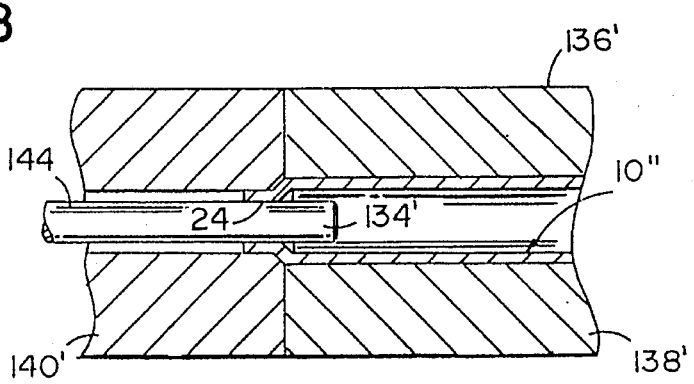
FIG. 19 is a side cross-sectional view of an external center pin and forming block for forming the ends of the valve guide insert.

Another method is illustrated in FIG. 19. This embodiment includes features similar to the embodiment shown on FIG. 18, and comparable components are denoted by a numeral with a prime following the number. In this embodiment, an end forming pin 144 is extended partially into an end of a cylindrically-shaped insert and forming block 140' is introduced against the end of partially formed insert 10" and against closed forming blocks 136', 138'. As forming block 140' crowns the end of insert 10", material is forced toward pin 144 thus forming tapered insertion sections 24", 26". Though only insert 10" is shown in FIGS. 16–19, it is contemplated that any of inserts 10 or 10' can be formed by these processes, and the particular devices shown are for illustration only.

Having described insert 10 and variations thereof, and installation tool 68 and also the process of forming inserts, the uses and advantages of the present invention will become apparent to one of ordinary skill in the art. Initially, insert 10 is formed by one of the aforementioned processes utilizing generally standardized manufacturing equipment to form coiled strip stock of phosphor bronze into inserts 10. Multiple of these inserts are made with particular thicknesses T, the inserts being radially compressible to close slit 18 and form particular diameters D1 and D2 which are desired.

Once formed, an insert 10 of desired size and configuration is selected and inserted onto mandrel 74 of a properly-sized driver member 70 with tapered insertion section 26 riding up onto outwardly tapered junction 82 (FIG. 9). Installation sleeve 72 is initially held over driver section 76 with spring 96 compressed as insert 10 is inserted onto mandrel 74. Installation sleeve 72 then slides downward from driver section 76 to partially overlie mandrel 74 and to partially overlie insert 10. In particular, installation sleeve 72 slides over tapered insertion section 26. As insert 10 is positioned on mandrel 74, junction 82 flexes the taper from tapered insertion section 26, permitting square driving shoulder 84 to apply a longitudinal force on section 26 for driving the insert into the valve guide bore.

With insert 10 thus held by installation sleeve 72 on driver member 70, insert 10 is ready to be installed. Insert 10 is first aligned with valve guide bore 12 (FIGS. 4 and 5), with leading tapered insertion section 24 placed within the bore 12. Driver 70 is then driven downwardly with an impact gun (not shown) or the like. Flat driving surface 84 engages end 22 of insert 10 (FIG. 5) and drives insert 10 into place. Installation sleeve 72 slides upwardly on driver section 76 of shank 68 until it abuts the face 104 of shank 68. Thus, insert 10 is slidingly installed in a press-fit condition into valve guide bore 12 at a predetermined depth (FIG. 11). Driving member 70 is then withdrawn and another insert 10 is placed thereon. The sequence is then repeated.

Once all inserts are in place, each is reworked such as by broaching to bring the insert into the configuration shown in FIG. 1. This reworking process insures not only that the insert will be seated firmly within the bore 12, but that its wall thickness will be constant or near-constant throughout its length.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. A method for lining and relining a valve guide bore of an internal combustion engine comprising:

providing an engine component including material defining a valve guide bore and an opening to the valve guide bore, the material defining the opening to the valve guide bore including a generally square lip;

providing a thin-walled valve guide insert including an intermediate section and at least one end having a reduced inner diameter and a reduced outer diameter relative to the intermediate section defining a tapered insertion section, the tapered insertion section and the intermediate section defining a substantially continuous wall thickness;

providing an installation tool for the valve guide insert, the installation tool having a mandrel section constructed to be inserted into said valve guide insert;

placing the valve guide insert onto the mandrel section of the installation tool;

aligning the valve guide insert with the valve guide bore by inserting the tapered insertion section of the one end of the valve guide insert partially into the valve guide bore with the tapered insertion section contacting the generally square lip of the valve guide bore; and driving the valve guide insert into press-fit engagement with the valve guide bore by use of the installation tool, whereby the valve guide insert can be inserted into the valve guide bore past the generally square lip without being prone to crush during installation of the valve guide insert into the valve guide bore.

2. A method as defined in claim 1 wherein the valve guide insert includes end sections and further includes a slit extending the length of the valve guide insert, wherein the installation tool further includes a driver section connected to the mandrel section and an installation sleeve constructed to slide from the driver section partially onto the mandrel section to compressingly hold the valve guide insert on a pilot section with the slit being held in a near closed or closed position and the end section remote from the valve guide bore being supported between the mandrel section and the installation sleeve, and including the step of placing the valve guide insert onto the installation tool between the mandrel section and the installation sleeve prior to said driving step.

3. A method as defined in claim 2 wherein the installation tool includes a frusto-conical junction interconnecting the pilot section and the driver section, and wherein the step of placing the valve guide insert on the installation tool includes pressing a bore-remote end section of the valve guide insert onto the frusto-conical junction and retaining it within said installation sleeve so that any taper is removed at least in part from the bore-remote end section during said driving step.

4. A method as defined in claim 2 further including a step of reworking the valve guide insert after inserting the valve guide insert into the valve guide bore to form an inner diameter for accepting a valve stem, said reworking step including the step of at least partially reforming the tapered insertion section of the valve guide insert.

5. A method as defined in claim 1 further including a step of reworking the valve guide insert after inserting the valve guide insert into the valve guide bore to form an inner diameter for accepting a valve stem, said reworking step including the step of at least partially reforming the tapered insertion section of the valve guide insert.

6. A method as defined in claim 1 wherein said at least one end includes two ends having a tapered insertion section, and includes a step of selecting one of said two ends for engagement with the material defining the valve guide bore of the engine.

7. A method as defined in claim 1 wherein the valve guide insert includes a slit extending at least partially longitudinally through the tapered insertion section, and includes a step of compressing the tapered insertion section to close or nearly close the slit as the valve guide insert is extended into the valve guide bore of the engine.

* * * * *